US008087545B2

(12) United States Patent
Ciavarella et al.

(10) Patent No.: US 8,087,545 B2
(45) Date of Patent: Jan. 3, 2012

(54) COUNTER MOUNTED DISPENSING SYSTEM

(75) Inventors: Nick E. Ciavarella, Seven Hills, OH (US); Mark E. Rosenkranz, Parma, OH (US); David D. Hayes, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 12/901,732

(22) Filed: Oct. 11, 2010

(65) Prior Publication Data

US 2011/0024447 A1 Feb. 3, 2011

Related U.S. Application Data

(63) Continuation of application No. 11/188,266, filed on Jul. 25, 2005, now Pat. No. 7,815,074.

(51) Int. Cl.
*B67D 7/32* (2010.01)

(52) U.S. Cl. ..... 222/153.09; 222/180; 141/383

(58) Field of Classification Search ..... 222/153.01, 222/153.03, 153.04, 153.09, 153.1, 1, 180, 222/320, 321.7, 372, 383.1; 141/1, 2, 383–386
See application file for complete search history.

(56) References Cited

U.S. PATENT DOCUMENTS

| | | | | |
|---|---|---|---|---|
| 1,789,338 | A * | 1/1931 | Kooperstein | 222/385 |
| 6,929,150 | B2 * | 8/2005 | Muderlak et al. | 222/1 |
| 7,621,426 | B2 * | 11/2009 | Reynolds et al. | 222/325 |
| 2003/0089741 | A1 * | 5/2003 | Hubmann et al. | 222/153.01 |

* cited by examiner

*Primary Examiner* — J Casimer Jacyna
(74) *Attorney, Agent, or Firm* — Renner Kenner Greive Bobak Taylor & Weber

(57) ABSTRACT

A combination product container and pump includes a product container including a neck providing an open top, and a lug proximate a base of the neck. A pump is fitted within the open top and includes a piston. A cap provides a piston aperture and secures the pump to the container. The piston of the pump extends through the piston aperture. A dispensing tube port is offset from the piston. A collar key is fitted over the cap. The collar key includes an actuator aperture, and the piston extends through the actuator aperture. The collar key further includes a dispensing tube slot, and the dispensing tube port extends through the dispensing tube slot. The collar key also includes a notch that is circumferentially offset from the dispensing tube slot, the notch being fitted over the lug of the product container such that the dispensing tube slot and the dispensing tube port must occupy a particular orientation with respect to the lug.

1 Claim, 15 Drawing Sheets

COUNTER MOUNTED DISPENSING SYSTEM

RELATED APPLICATIONS

This application is a continuation of U.S. patent application Ser. No. 11/188,266, filed Jul. 25, 2005, now U.S. Pat. No. 7,815,074 which is incorporated herein in its entirety.

TECHNICAL FIELD

The present invention generally relates to product dispensing systems, and, more particularly, relates to counter mounted dispensing systems, wherein refill product containers are mounted in the dispensing system under a counter.

BACKGROUND OF THE INVENTION

Dispensing systems typically include mechanisms for selectively receiving refill product containers so that, when the product container mounted in the dispensing system is empty, it can be removed and replaced by a new, full product container. In counter mounted dispensing systems, the removal of an empty product container and replacement thereof by a new product container can be very difficult. The individual removing the old product container and installing the new one must either due so blindly, by reaching under the counter and removing and installing by feel alone, or must get down below the counter to be able to view the elements involved in the removal and installation. Additionally, the product containers and the mechanisms for their selective receipt are typically placed in tight quarters, most often between a sink basin and one or more walls. Thus, even if the individual bends down below the counter to view the elements, manipulating those elements might be difficult.

In the prior art, cylindrical refill product containers are provided, and they generally are secured to the elements of the dispensing system through relative rotation, i.e., the refill product container is rotated relative to the container-receiving elements of the dispensing system in order to be selectively installed or removed therefrom. While the cylindrical shape of the refill product containers allow them to be rotated in these tight quarters, it should be appreciated that they do not provide a maximum refill container volume, inasmuch as a refill container with a square cross-section having sides equal to the diameter of the cross-section of a cylindrical container would, assuming they are of the same height, provide a larger volume for the product held in the container. However, in such tight quarters, containers of square or rectangular cross-section might not be permitted to rotate. If provision could be made for their selective receipt, refill product containers having rectangular cross-sections would be preferred, because they would maximize the utilization of scarce space and provide more product than the cylindrical counterpart.

In light of the dispensing systems provided by the prior art, a need exists for a counter mounted dispensing system that provides mechanisms for the installation and removal of refill containers that are conducive to use even when not being viewed by the individual using them. There is an additional need for counter mounted dispensing systems that employ refill product containers of rectangular cross-section, even though the position of receipt of the product container is the dispensing system does not allow for relative rotational movement of the product container in relation to the position of receipt.

SUMMARY OF THE INVENTION

In accordance with one embodiment of this invention, improvements are provided in a counter mounted dispensing system that selectively receives product containers under the counter for dispensing the product above the counter, wherein the product container, when received under the counter, is in close proximity to a wall. Improvements are made by providing a container receptacle under the counter to define a position of receipt for the product container, and providing the product container with a shape such that, at the position of receipt, the product container cannot be rotated along its vertical axis because, upon such rotation, the product container would come into contact with a wall and be thereby forced out of the position of receipt. In accordance with this improvement, the product container is received in the container receptacle and held thereby without the need for rotating the product container.

In particular embodiments of this invention, particular structures are provided in a counter mounted dispensing system for receiving a product container without the need for rotating the product container relative to other elements of the dispenser. Thus, in accordance with another embodiment of this invention a counter mounted dispensing system is provided comprising a product container having a collar key; a bottom support having an open end for the insertion of the product container; and a container release mechanism in the bottle support. The container release mechanism includes a release ring that is movable between a container support position and a container release position, and the release ring is biased to the container support position. At least one protrusion having a ramped surface and a support surface is provided on the collar key, and at least one protrusion having a ramped surface and a support surface is provided on the release ring such that, upon insertion of the product container into the open end of the bottle support, the ramped surface of the at least one protrusion on the collar key contacts the ramped surface of the at least one protrusion on the release ring and the ramped surfaces interact to move the release ring against the bias toward the container support position until the ramped surfaces pass one another and the release ring is moved back to the container support position by the bias against the release ring and the support surface on the collar key rests on the support surface on the release ring such that the product container is held in the bottle support.

In accordance with another embodiment of this invention, a counter mounted dispensing system provides means for facilitating the blind installation of a product container therein. In accordance with such an embodiment, a counter mounted dispensing system includes a product container; and a bottle support having an alignment skirt defining an open end of the bottle support for the insertion of the product container. The alignment skirt provides a specific cross-sectional shape, and the product container includes a body having a complimentary cross-sectional shape such that the product container may only be inserted into the open end of the bottle support in a given orientation wherein the cross-sectional shapes of the body and the bottle support are in the same orientation. In a specific embodiment, the product container has a neck, a body, and a shoulder extending from the neck to the body, and the shoulder contacts the open end of the alignment skirt of the bottle support, when the cross-sectional shapes of the body and the bottle support are not in the same orientation.

PREFERRED EMBODIMENT FOR CARRYING OUT THE INVENTION

Figure 1:
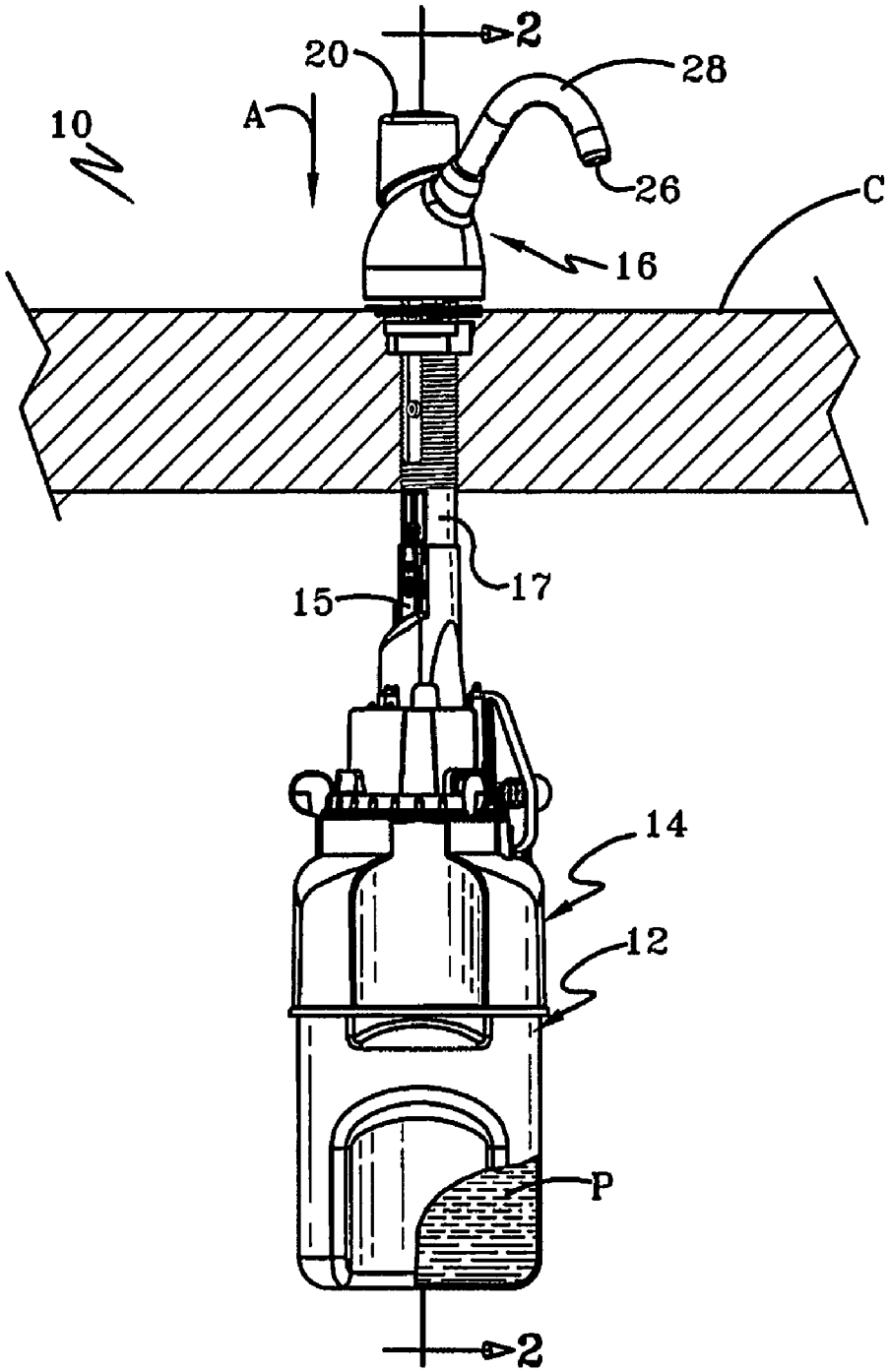
FIG. 1 is a perspective view of a counter mounted dispensing system in accordance with this invention, shown as it might be mounted to a counter.
Figure 2:
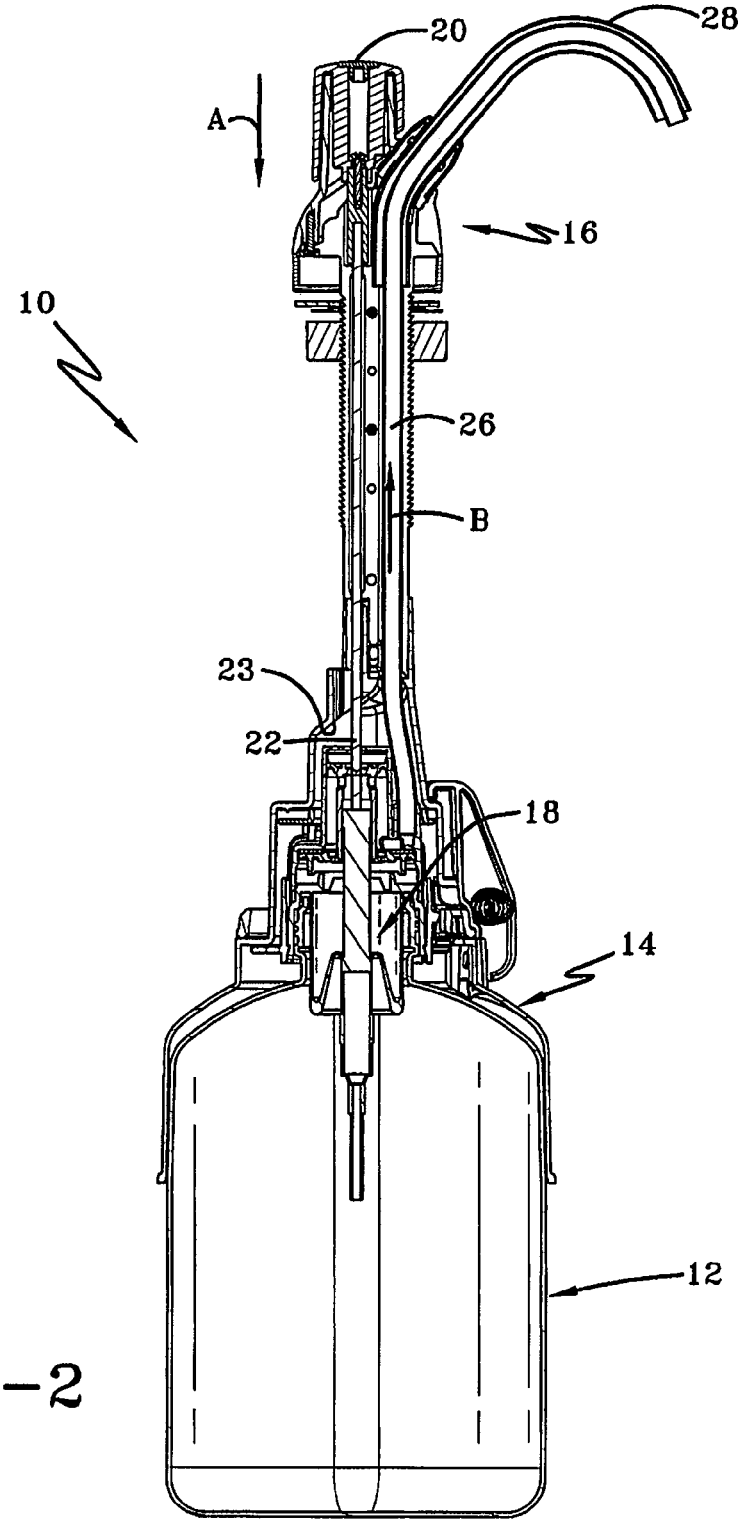
FIG. 2 is a side, cross-sectional view of the counter mounted dispensing system of FIG. 1, taken along the line 2-2 in FIG. 1.
Figure 3:
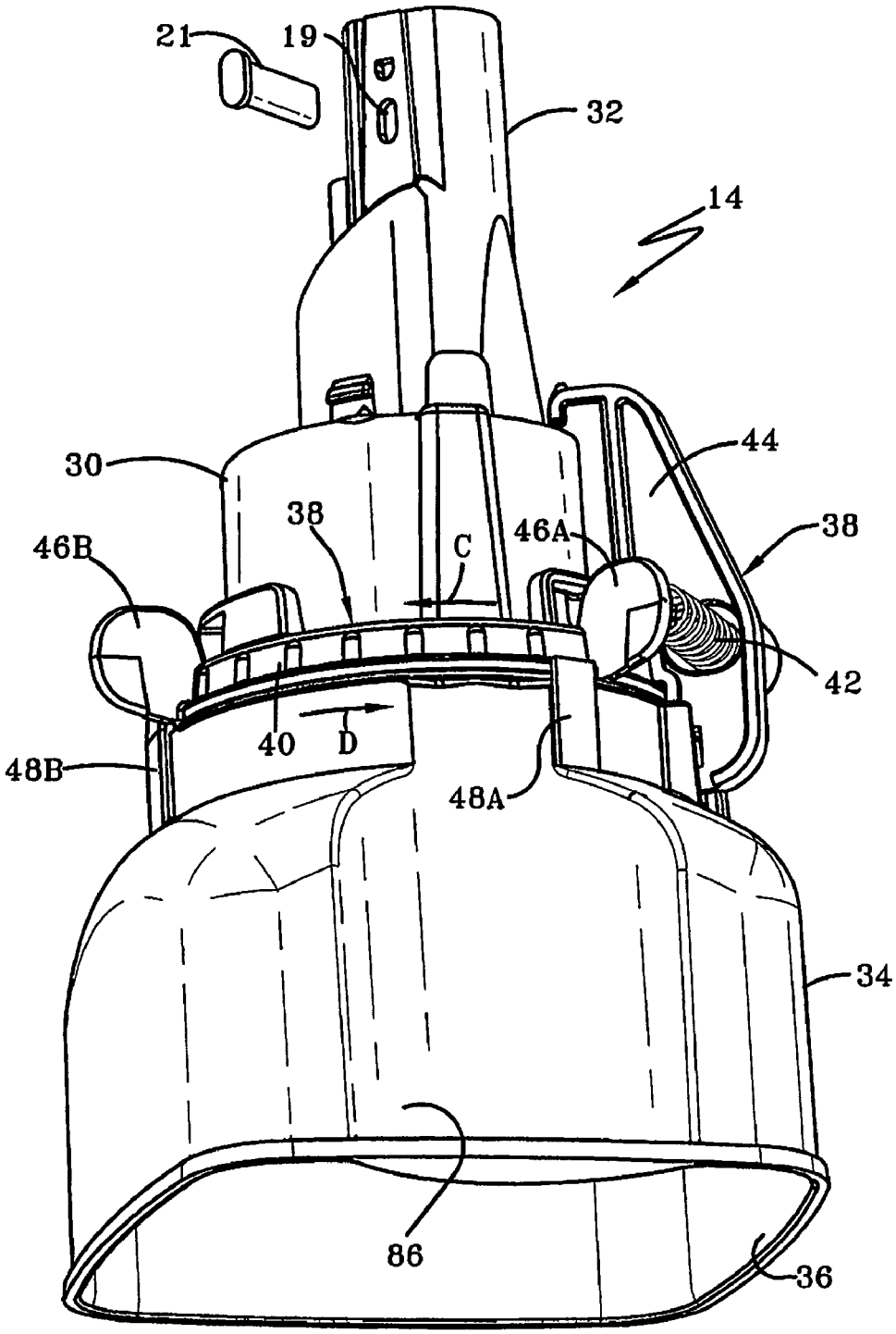
FIG. 3 is a perspective view of the bottle support of the dispensing system.

Referring now to FIGS. 1 and 2, a counter mounted dispensing system in accordance with this invention is shown and designated by the numeral 10. In FIG. 1, system 10 is shown as it might be mounted to a counter C. System 10 includes product container 12 holding product P to be dispensed when product container 12 is properly mounted in system 10. Generally, the product P held within container 12 will be a liquid or other generally flowable material that can be pumped against gravity to be dispensed. Container 12 is received in bottle support 14, and dispensing head 16 is secured to bottle support 14 at connector 15, preferably without the need for rotating bottle support 14 relative to head 16. An extension 17 of head 16 telescopes into connector 15 until apertures (not shown) in extension 17 align with apertures 19 (only one is viewed in FIGS. 1 & 3) and lock pin 21 is inserted therethrough (FIG. 3). Pumping mechanism 18 is secured to container 12 and actuated to dispense product P. The present invention is particularly concerned with hand soap and hand sanitizing dispensers, and therefore, it should be appreciated that the product P may be dispensed as either a liquid or foam, according to the particular type of pump mechanism employed. Virtually any type of pump mechanism 18 may be employed, and, thus, undue emphasis should not be placed on the particular pump mechanism shown in the figures and disclosed herein.

Dispensing head 16 includes plunger 20, which is pressed downwardly in the direction of arrow A to push pump actuator 22 to operate pump mechanism 18 to force product P through dispensing tube port 24 (FIG. 4) and dispensing tube 26 of pump mechanism 18, up and out of spout 28, in the direction of arrow B. More basic or more complicated designs of pump mechanisms and dispensing heads and pump actuators may be employed, as these elements are only of concern in a particular embodiment of this invention. The main focus of this invention is on the concepts relating to the receipt of a product container in a bottle support, particularly in the environment of a counter mounted dispensing system that is mounted in close proximity to a wall. Initially, the elements of the counter mounted dispensing system are disclosed, and the advantages realized when mounting the system close to a wall are disclosed thereafter.

Bottle support 14 is shown alone in FIG. 3, and includes neck 30, dispensing head connector 32, and alignment skirt 34. Alignment skirt 34 provides open end 36 for the insertion of container 12, and a container release mechanism generally designated by the numeral 38 and located at neck 30 serves to support container 12 when it is fully inserted into bottle support 14 in an appropriate orientation. Container release mechanism 38 includes release ring 40, which is rotatably mounted at neck 30 and movable between a container support position and a container release position. Release ring 40 is normally biased to the container support position, in the direction of arrow C, by an appropriate bias force. The bias force is provided here by compression spring 42, acting between spring plate 44 and ring tab 46A. Alternative biasing means may be employed. Multiple ring tabs are provided and designated by the numeral 46, and distinguished by letter designations A and B. A third ring tab exists in the embodiment shown, spaced substantially equidistant from 46A and 46B, but it cannot be seen in the views shown. Movement of release ring 40 in the direction of arrow C is limited by contact between one or more ring tabs 46A, 46B (or the unseen ring tab) and associated tab stops 48A, 48B (or a stop associated with the unseen ring tab). The container release position is reached by rotating release ring 40 in the direction of arrow D, and movement in that direction is limited by contact between ring tab 46A and spring plate 44. Ring tab 46A is the preferred tab to access when manipulating release ring 40, because it is easy to grip both spring plate 44 and ring tab 46A to squeeze ring tab 46A toward spring plate 44. Container release mechanism 38 interacts with a collar key secured on the container 12, over the pump mechanism, to selectively retain the product container in and release container 12 from bottle support 14.

Figure 4:
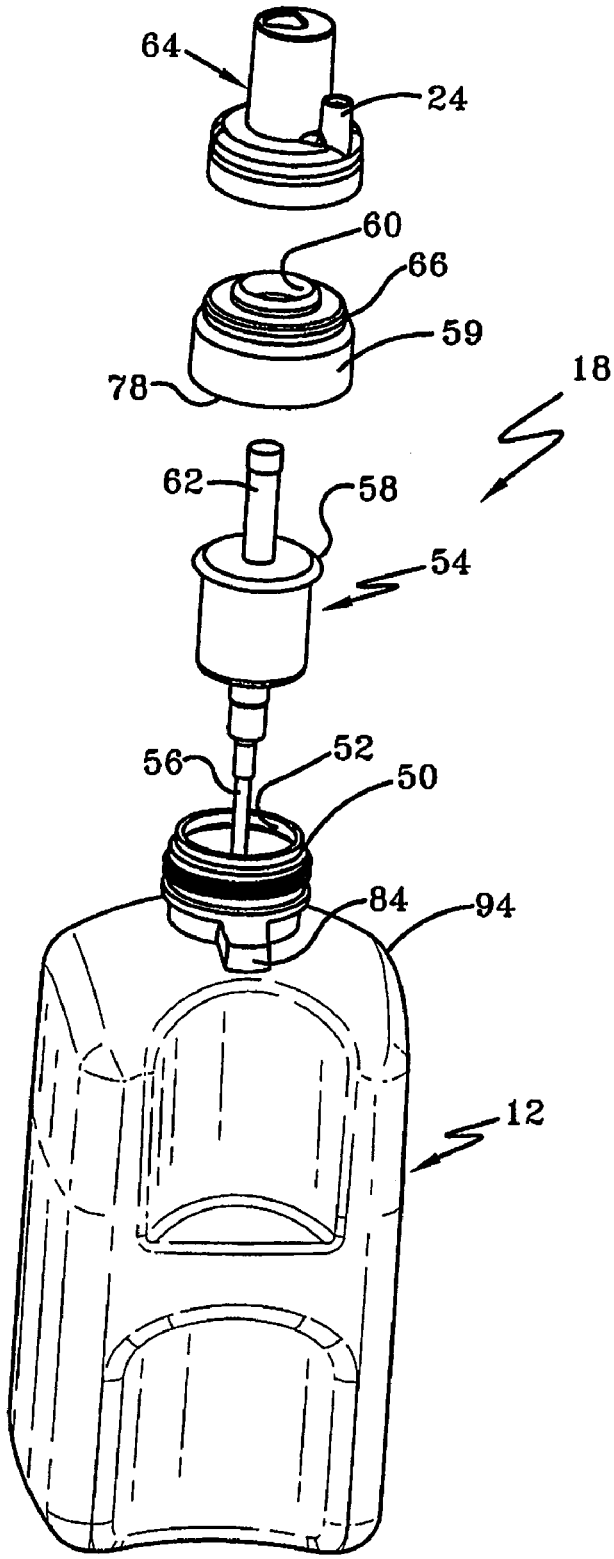
FIG. 4 is an assembly diagram of the product container and pump mechanisms in accordance with a particular embodiment of this invention.
Figure 5:
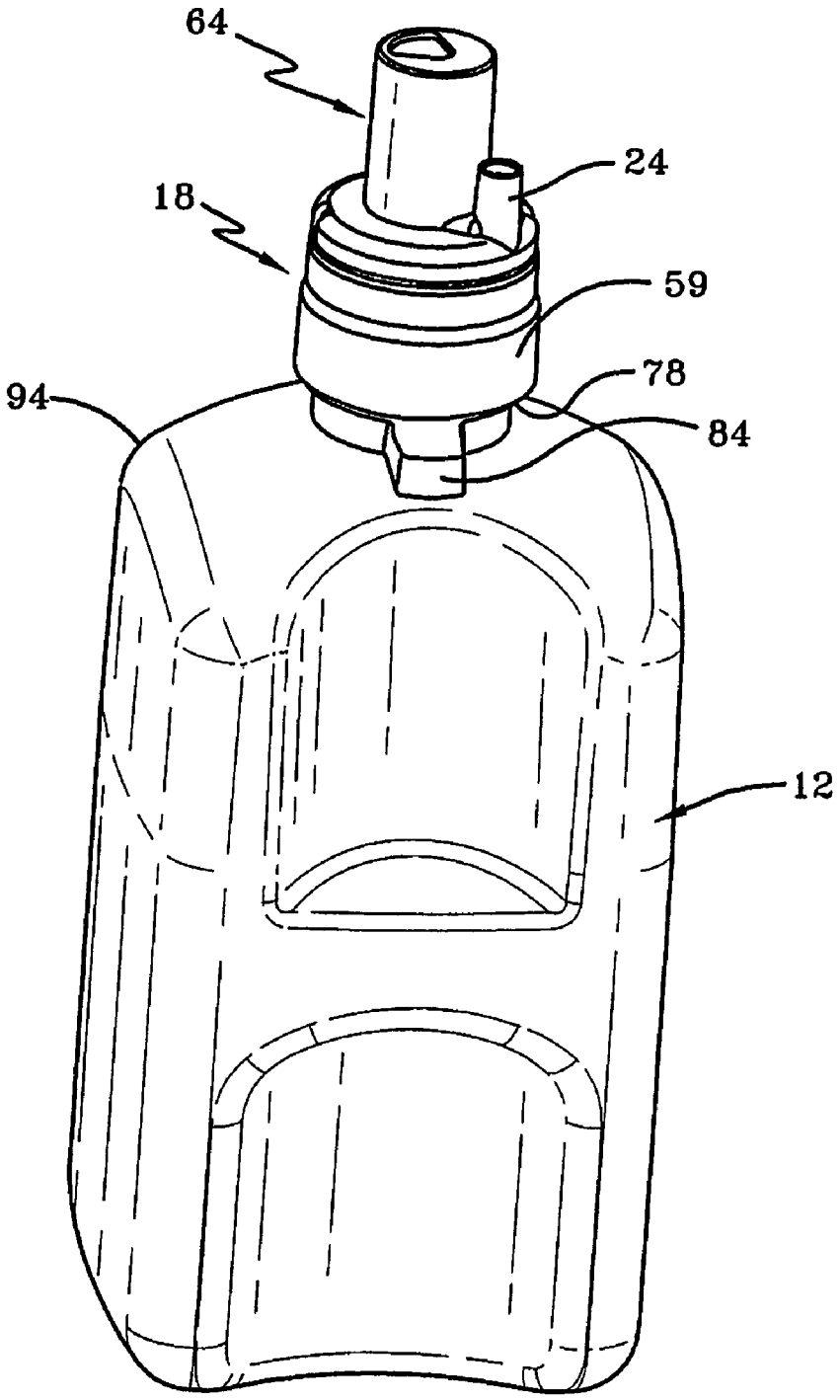
FIG. 5 shows the product container and pump mechanism of FIG. 4 as assembled.
Figure 6:
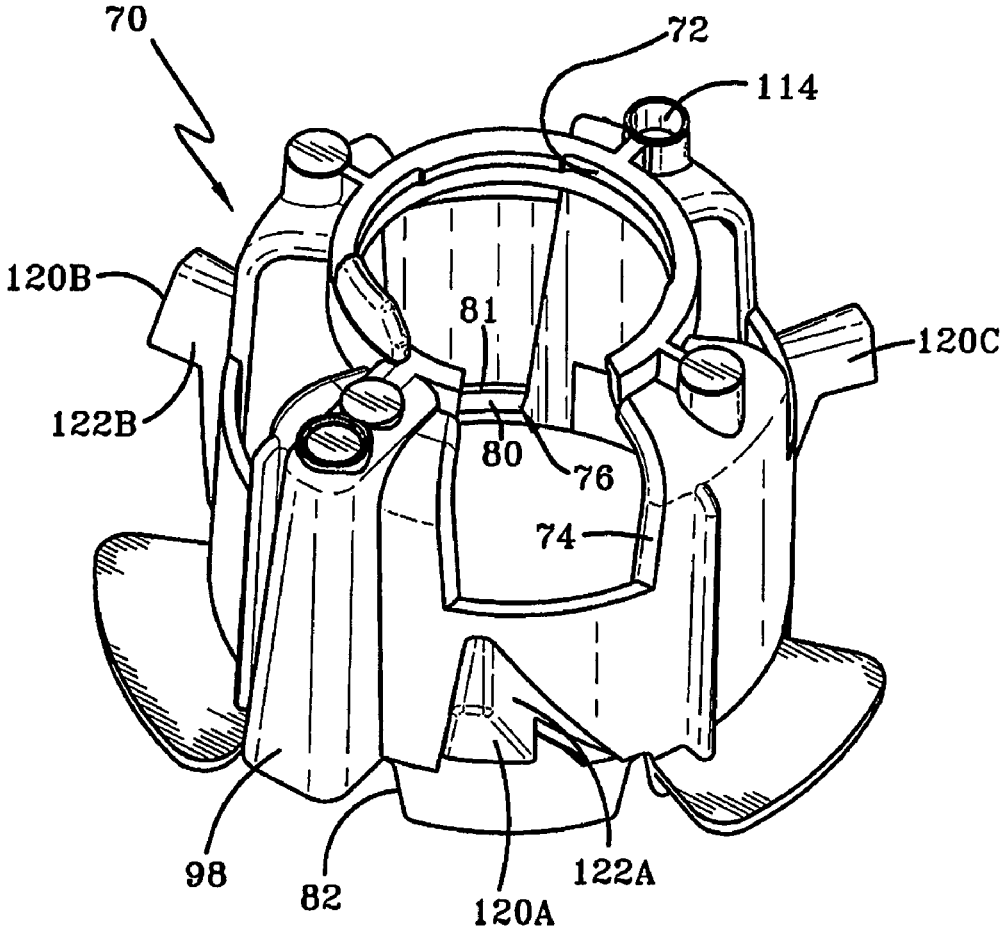
FIG. 6 is a perspective view of a collar key used in this invention.
Figure 7:
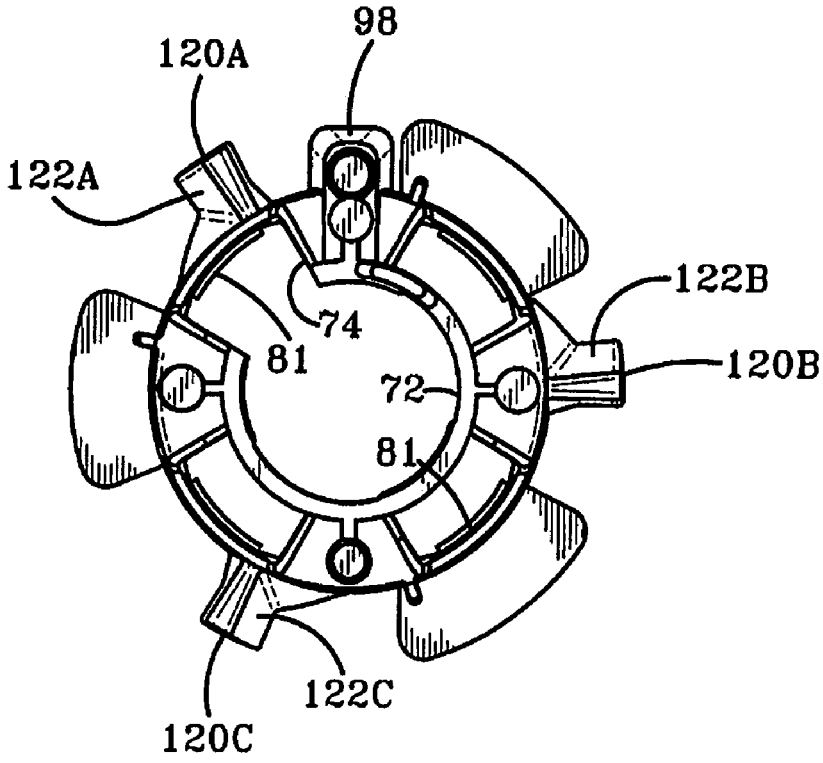
FIG. 7 is a top view of the collar key.
Figure 8:
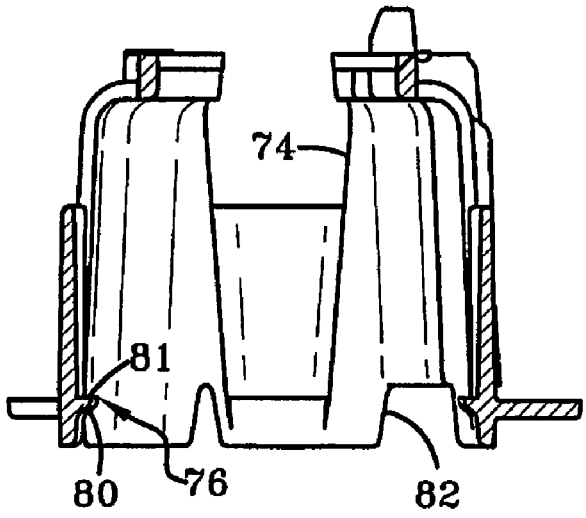
FIG. 8 is a bottom view of the collar key.
Figure 9:
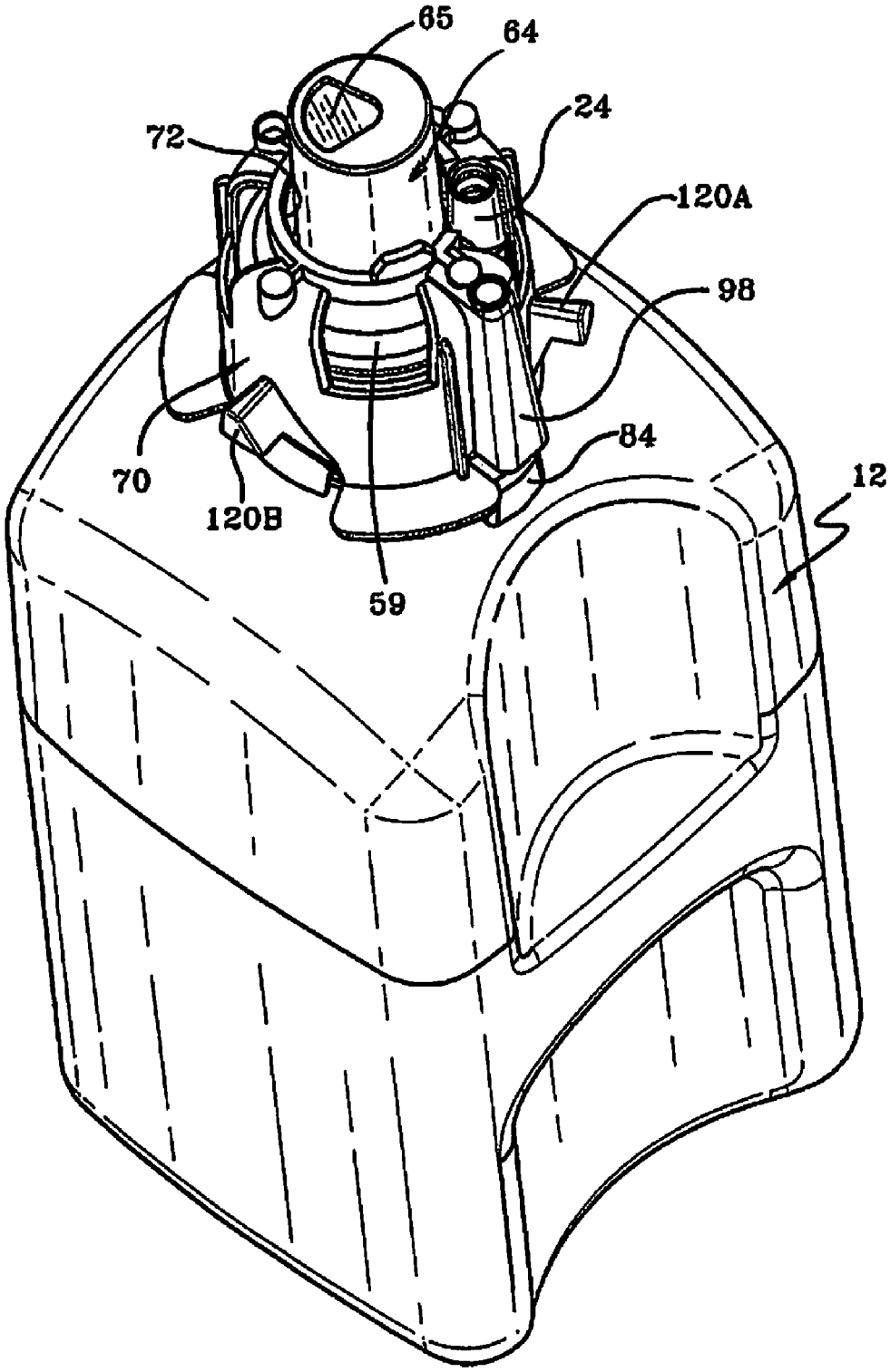
FIG. 9 is a perspective view of a collar key fitted on a product container over pump mechanisms assembled into the product container.

Product container 12 and pump mechanism 18 are shown in more detail in FIGS. 4 and 5. Container 12 includes threaded neck 50 defining an open top 52, which, in accordance with this embodiment, receives a standard foam pump 54 with a one-way valve dip tube 56. Foam pump 54 is associated with container 12 by being inserted into open top 52 with radial flange 58 of foam pump 54 resting on open top 52. Threaded cap 59 threads onto threaded neck 50, over foam pump 54, and provides piston aperture 60, through which piston 62 of foam pump 54 extends. Suction pump member 64 snaps onto cap 59 through a snap fit between radial channel 66, in cap 59, and radial flange (not seen), on the inside diameter of suction pump member 64. Suction pump member 64 is preferably similar to that shown in U.S. Pat. No. 7,431,182 incorporated herein by reference.

As already mentioned above, the particular type of pump mechanism 18 is not necessarily pertinent to all aspects of this invention. Thus, this invention is not to be limited to or by any particular type of pump mechanism. It should be appreciated that foaming pumps or non-foaming pumps may be employed, and pumps employed in this invention need not have suction pump members. Indeed, it is not absolutely necessary that a pump mechanism be carried by the product container inasmuch as the pump mechanics may be provided elsewhere in the dispenser system so long as some type of access is provided to the contents of the product container.

Container release mechanism 38 interacts with a collar key on product container 12 to selectively retain the container in and release the container from bottle support 14. The collar key is more particularly disclosed with reference to FIGS. 6-9, wherein it is shown and designated by the numeral 70. Collar key 70 fits over suction pump member 64 and cap 59, and provides actuator aperture 72 for piston portion 65 of suction pump member 64. Aperture 72 is disclosed here as an "actuator" aperture because this aperture lets actuator 22 (FIG. 2) ultimately actuate the pump mechanism of foam pump 54 held by container 12. Here, actuator 22 actuates pump 54 through contact with piston portion 65 of suction pump 64, which, in turn, actuates piston 62 of pump 54, but the invention is not limited thereto or thereby. Collar key 70 also includes dispensing tube slot 74 for dispensing tube port 24 and dispensing tube 26 (FIG. 2). Actuator aperture 72 and dispensing tube slot 74 are numbered individually because they do not necessarily have to be provided as one aperture in collar key 70, as they are shown in the figures.

Collar key 70 is secured to cap 59 by a plurality of inwardly projecting steps 76 that snap under bottom 78 of cap 59. More particularly, collar key 70 is slid over cap 59, and the inner dimensions of collar key 70 are such that beveled surfaces 80 of inwardly projecting steps 76 intimately contact cap 59 and are urged outwardly thereby, snapping into place under bottom 78 of cap 59 and being retained by catch surface 81 once steps 76 pass thereby. It is preferred that this permanently locks collar key 70 onto and over cap 59 and the particular pump mechanism (here 18) retained thereby. At least one notch 82 on collar key 70 is provided to fit over at least one lug 84 located at the base of neck 50 of container 12. It should be appreciated that collar key 70, when fit over lug 84 in this manner, cannot be rotated relative to container 12, because such rotation would cause notch 82 to dig into lug 84 and possibly damage container 12, ultimately poking a hole in lug 84.

Figure 10:
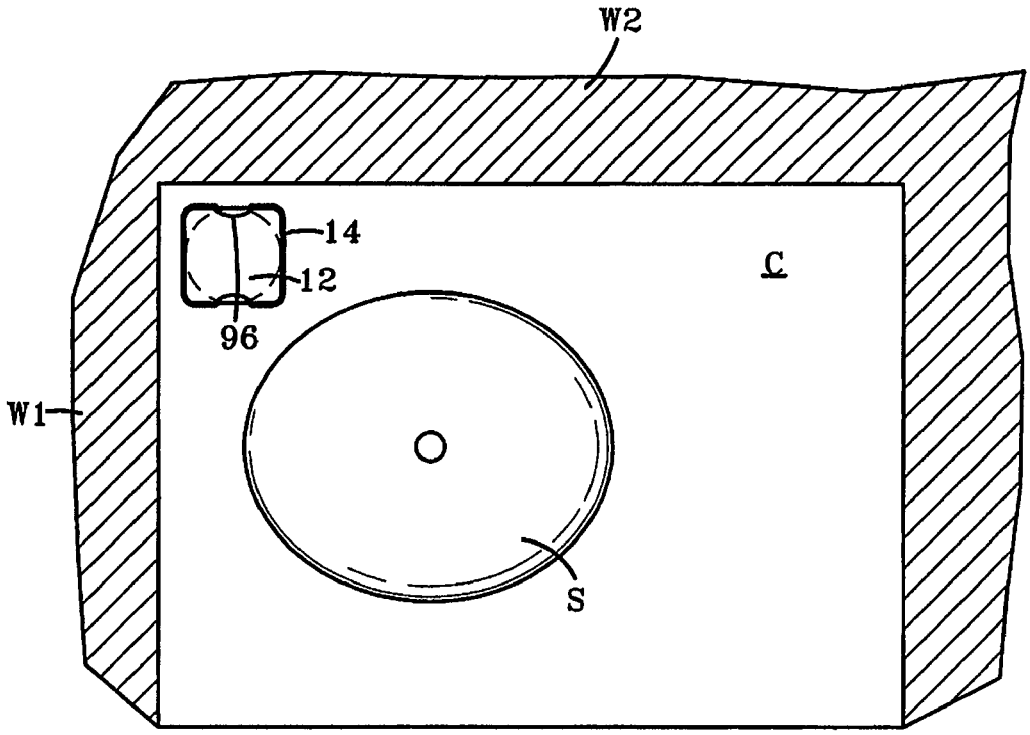
FIG. 10 is a bottom plan view generally representing a an under-the-counter environment in which a counter mounted dispensing system of this invention may be mounted.
Figure 11:
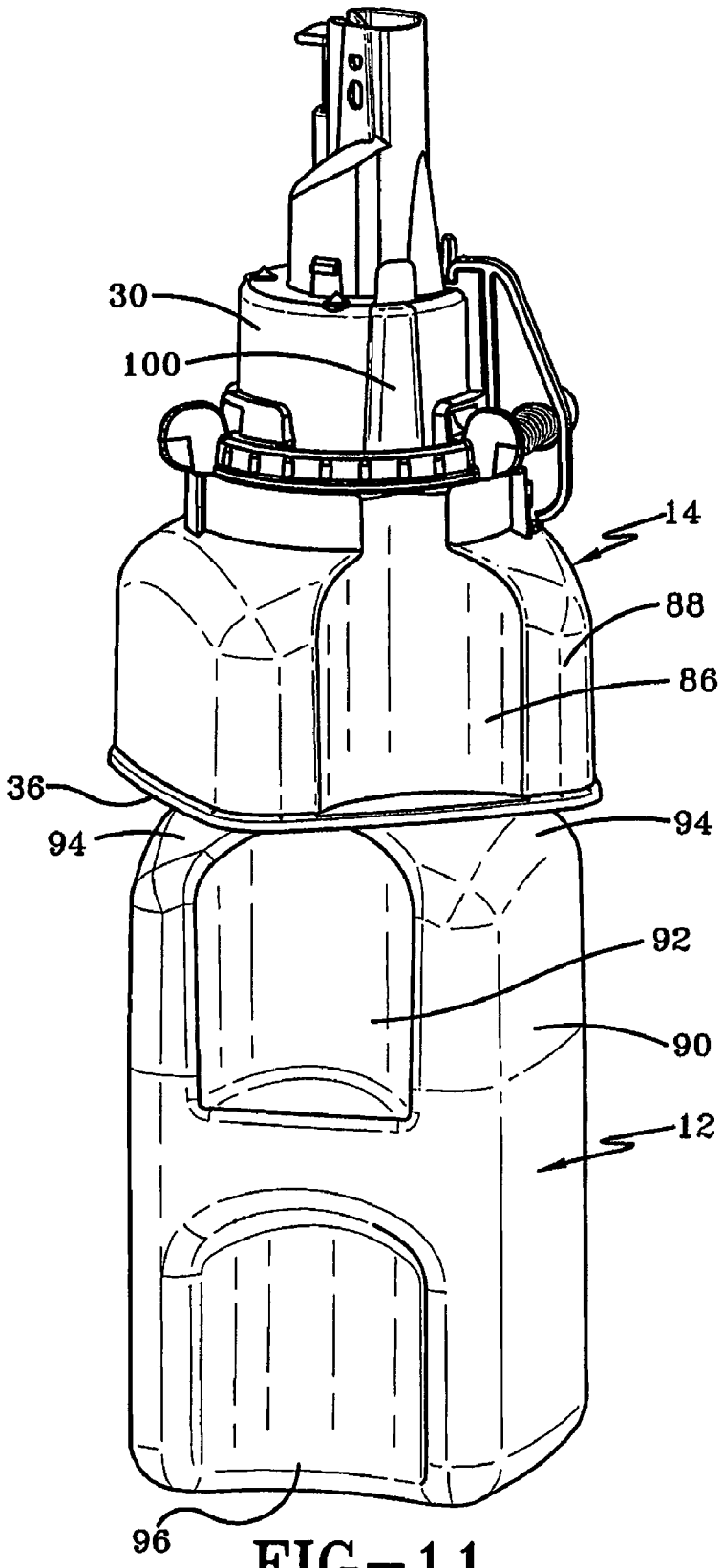
FIG. 11 is a perspective view of a bottle support that is to receive a product container, showing the product container out of proper alignment for such receipt.
Figure 12:
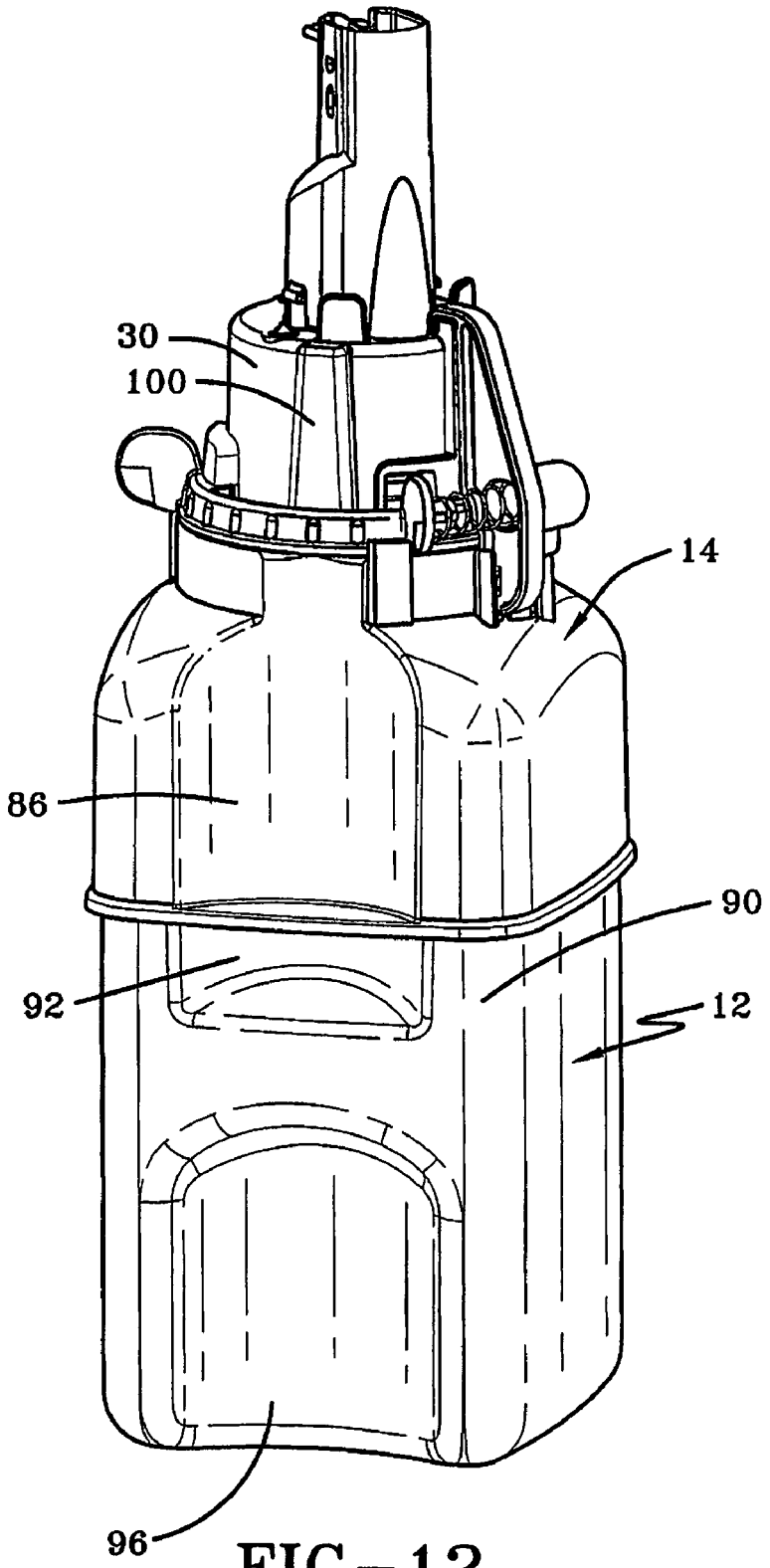
FIG. 12 is a perspective view of a bottle support receiving a product container, the product container being in proper alignment for such receipt.

With reference to FIGS. 10-12, the manner in which a product container is received in a bottle support in accordance with this invention will be shown and disclosed. Bottle support 14 is retained under counter C such that an individual installing product container 12 into bottle support 14 must either do so blindly, by reaching under the counter C and installing by feel alone, or must get down below the counter to see the elements involved in the installation. Bottle support 14 and product container 12 are shown in a preferred mounting position, near a corner of a room, between sink basin S and walls W1 and W2. It will be appreciated that product container 12 has a generally rectangular cross-section (but for its detents) and, with such a shape and in such a position of receipt as that shown, cannot be rotate along its vertical axis (represented by the center point drawn on container 12 in FIG. 10) because, upon such rotation, the product container would come into contact with one or more of walls W1 and W2 and would be forced out of the position of receipt. Thus, product container 12 cannot be configured to be received in bottle support 14 through relative rotation, as, for example, by the threaded engagement typically used in the art. A circular cross section would permit relative rotation, but would necessarily provide a refill container of lesser volume, as shown at phantom lines in FIG. 10. To increase the volume of product provided by product container 12 and received by bottle support 14, product container 12 preferably includes a rectangular cross section, fits close to a wall when received in bottle support 14 such that it cannot rotate at that position of receipt, and is received by bottle support 14 without rotating product container 12 relative to bottle support 14. Preferably, product container 12 is simply pushed up into bottle support 14, and mechanisms interact and move to hold product container 12.

From the above, it is clear that product container 12 should preferably be positioned in a given orientation for receipt in bottle support 14. This is true for receiving product container 12 in a specific orientation relative to walls and sink basins under the counter, as just disclosed above, and also for receiving product container 12 in the proper orientation due to structural features on collar key 70 and neck 30, in order to ensure that the correct type of product is being dispensed and to ensure that the dispensing tube 26 and pump piston 62 are properly oriented for proper actuation of the pump mechanism 18. In FIGS. 11 and 12, it can be seen that alignment skirt 34 of bottle support 14 includes detent 86, on at least one sidewall 88, extending to open end 36, and product container 12 likewise has body 90 that includes detent 92 on a complimentary sidewall such that product container 12 may only be inserted into open end 36 of bottle support 14 in a given orientation wherein the cross-sectional shapes of body 90 and alignment skirt 34 are in the same orientation, i.e., with detent 86 aligned with detent 92. When detents 86 and 92 do not align, shoulder 94 of product container 12 contacts open end 36 of alignment skirt 34, and, although product container 12 will not be received in such an orientation, shoulder 94 provides a rounded surface that permits the installer to blindly rotate product container 12 from the position of FIG. 11 to the position of FIG. 12, and, upon reaching the orientation of FIG. 12, product container 12 will slide up into bottle support 14. With reference to all FIGS. 10-12, it should be appreciated that product container 12 preferably includes at least one finger grip detent 96 that will accept an installer's fingers to provide a place for gripping product container 12 even when very close to a wall, such as wall W1 or W2.

During insertion of container 12 into bottle support 14, dispensing tube 26 must be inserted up through an aperture in the top of connector 15, and sloped surface 23 (FIG. 2) is provided in order to urge the flexible dispensing tube 26 toward and through the aperture. Thus, even the threading of the dispensing tube up and through the proper channels can be achieved blindly without squatting down below the counter.

Figure 13:
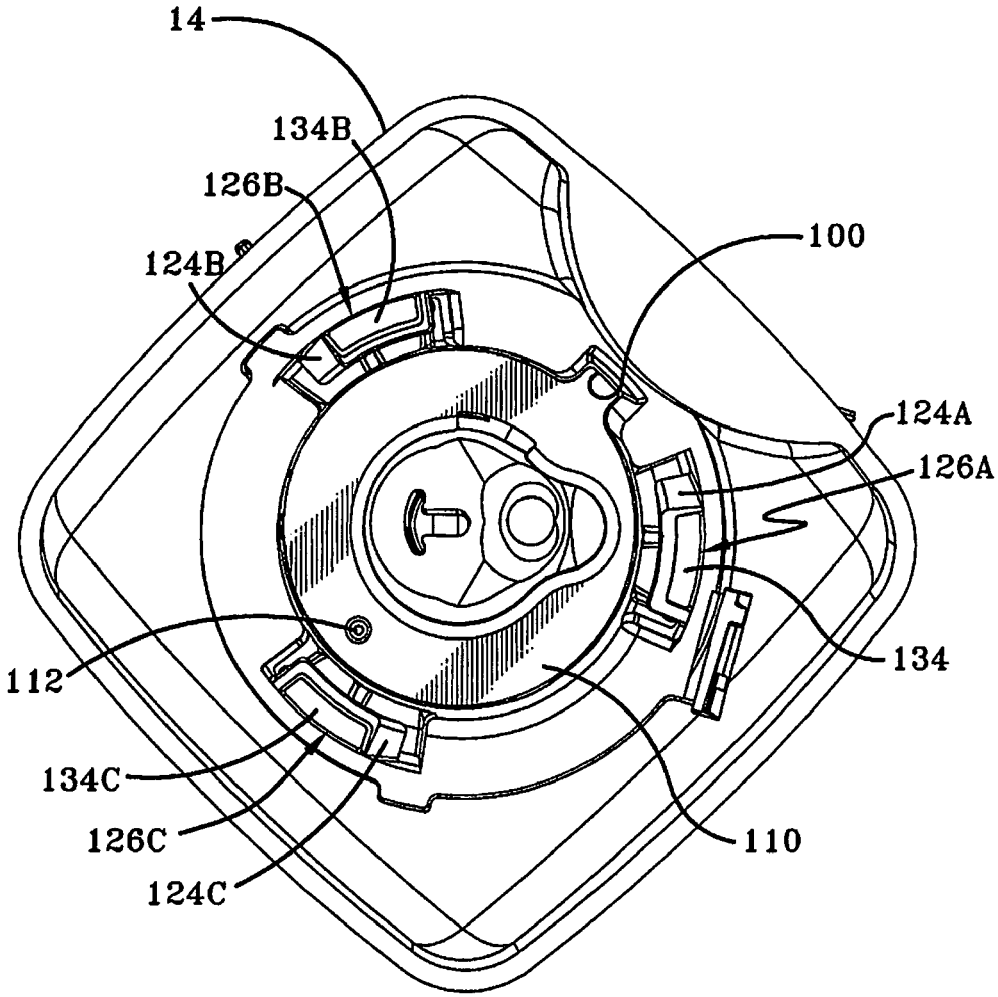
FIG. 13 is a bottom plan view of the bottle support, showing an optional lock plate therein for interaction with optional elements on a collar key.
Figure 14A:
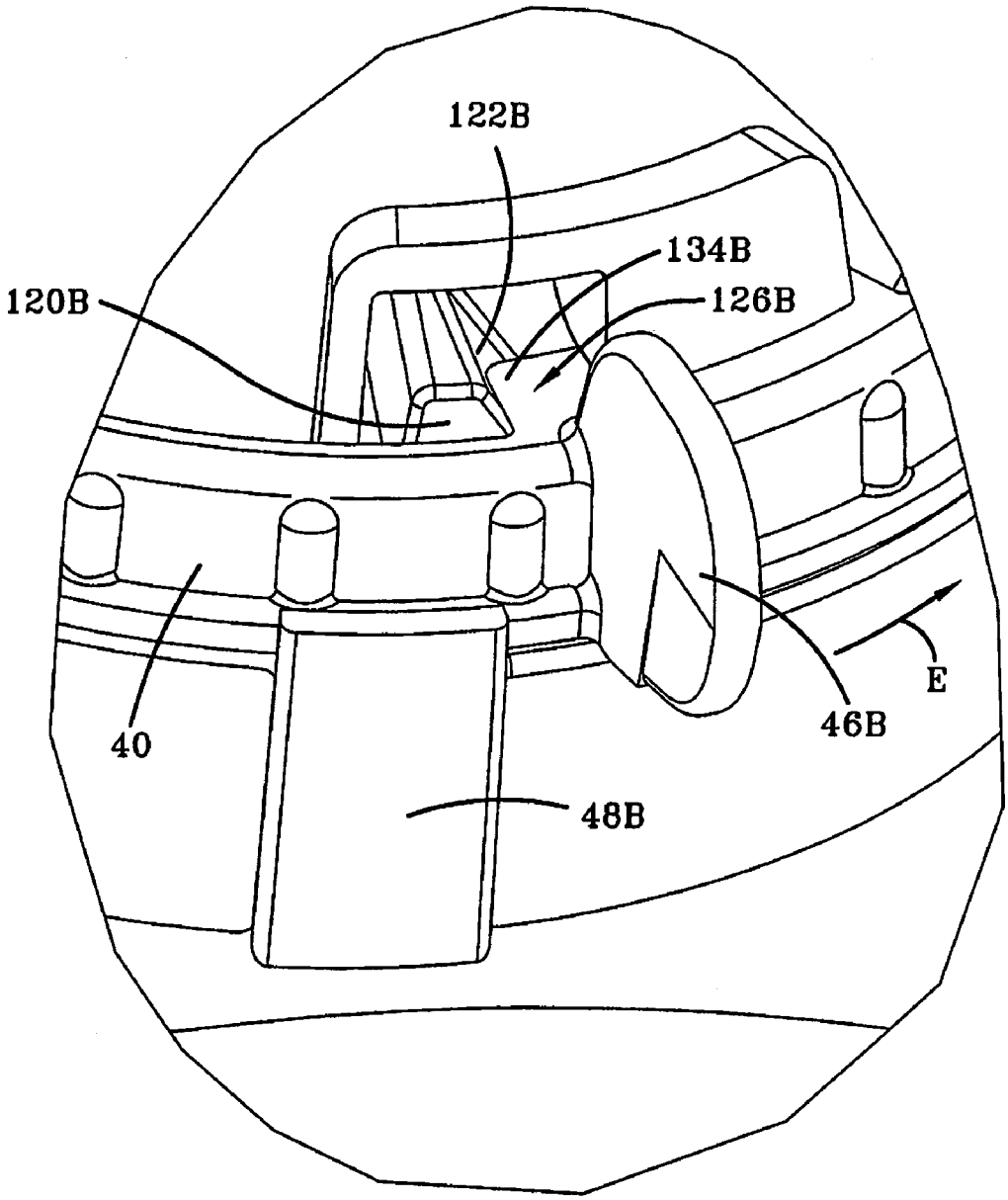
FIGS. 14A-C are exploded views of the interaction of a single protrusion on the collar key with a single protrusion on the release ring of the bottle support, it being appreciated that the other protrusions on the release ring and collar key interact similarly, to selectively retain a production container in the bottle support.
Figure 14B:
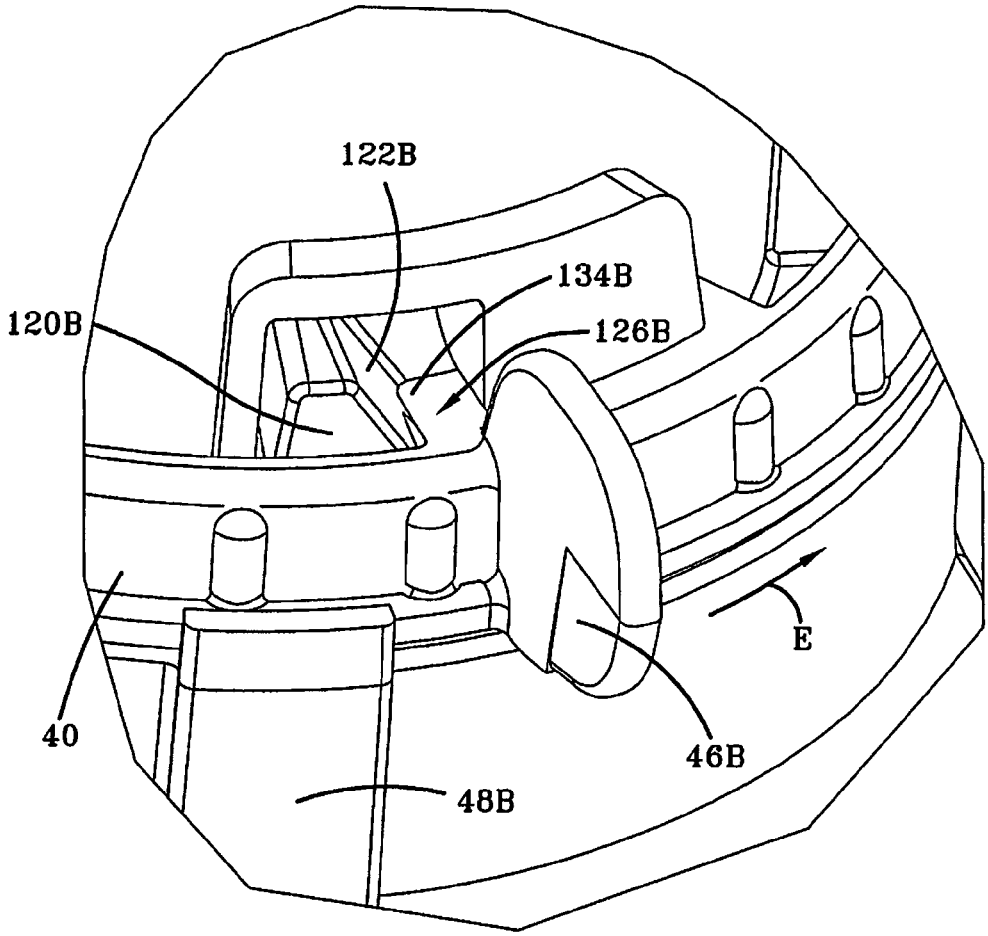
Figure 14C:
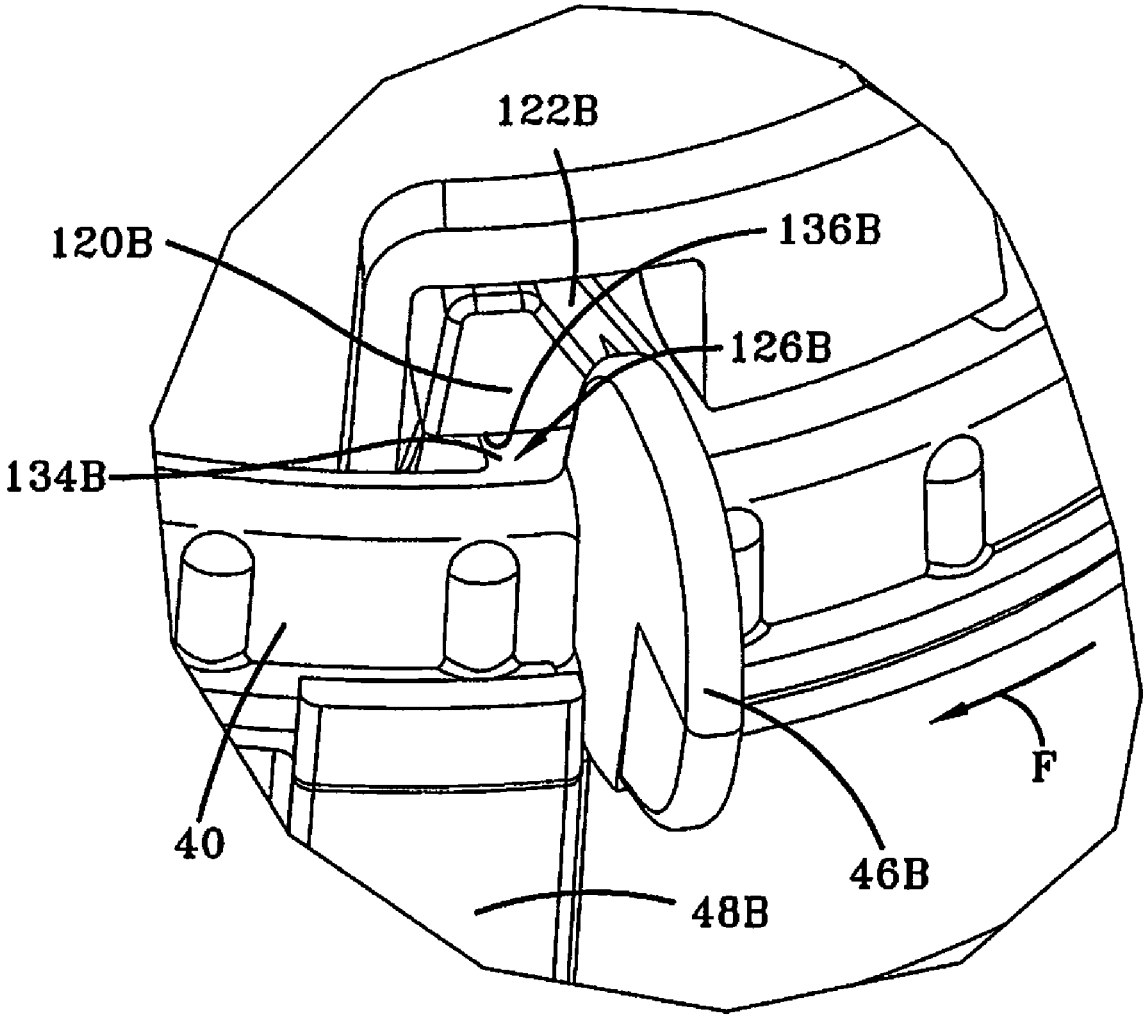

Once properly aligned, product container 12 is pushed upwardly and collar key 70 is received in neck 30 of bottle support 14. Because pumps can dispense different types of product, collar key 70 and neck 30 may be "keyed" to one another according to the type of product or products permitted or intended to be dispensed from a given dispensing system. Collar key 70 and neck 30 may be formed with specific cross-sections, as shown at rib 98 on collar key 70 (FIGS. 6-9), which mates with channel 100 in neck 30 (FIGS. 11, 12). A separate lock plate element may also be employed, as shown at the numeral 110 in FIG. 13. Lock plate 110 would include male and/or female members at specific locations, and collar key 70 would include complimentary female and/or male members for mating with the male and/or female members on lock plate 110, such that only a given collar key 70 corresponding with a desired type of product could be received in neck 30 having a given lock plate 110. This would help with product verification for quality control. Here, lock plate 110 is shown with male member 112 and collar key 70 is shown with female member 114 at a complimentary location. It should be appreciated that lock plate 110 may be a separate element or may be manufactured directly into neck 30.

The container release mechanism 38 and its interaction with collar key 70 is disclosed with reference to FIGS. 13 and 14A-C which show exploded views of the release ring 40 at ring tab 46B and its interaction with collar key 70 on container 12. During insertion of product container 12 into bottle support 14, container release mechanism 38 interacts with protrusions 120A, 120B, 120C (FIG. 7) on collar key 70 to receive container 12 without the need for rotating container 12 relative to bottle support 14. As collar key 70 moves up into neck 30, ramped surfaces 122A, 122B, 122C on protrusions 120A, 120B, 120C contact ramped surfaces 124A, 124B, 124C on protrusions 126A, 126B, 126C on release ring 40, which is biased to the position of FIGS. 3 and 12 by spring 42 acting between spring plate 44 and finger tab 46A extending from release ring 40. After contact, continued insertion of product container 12 into bottle support 14 causes the various ramped surfaces to push against one another, forcing release ring 40 in the direction of arrow E against spring 42. When the ramped surfaces pass one another, spring 42 forces release ring 40 back to its biased position, and support surfaces 134A, 134B, 134C of protrusions 126A, 126B, 126C rest under support surfaces 136A, 136B, 136C of protrusions 120A, 120B, 120C to hold product container 12 in bottle support 14. Notably, spring 42 causes release ring 40 to move in the direction of arrow F and "snap" into place once the protrusions pass each other, and this makes it easy for an installer to hear that the product container has been properly installed, even without having to get under a counter and observe the installation. Product container 12 may be blindly removed from bottle support 14 by feeling for one of finger tabs 46 and moving it against spring 42 to move the support surfaces of the protrusions out of alignment.

In light of the foregoing, it should thus be evident that the present invention provides a counter mounted dispensing system that substantially improves the art. In accordance with the patent statutes, only the preferred embodiments of the present invention have been described in detail hereinabove, but this invention is not to be limited thereto or thereby. Rather, the scope of the invention shall include all modifications and variations that fall within the scope of the attached claims.

What is claimed is:

1. A combination product container and pump comprising:

a product container including:

a neck providing an open top, a lug proximate a base of said neck, and a sidewall having a detent therein;

a pump fitted within said open top and having a piston;

a cap providing a piston aperture and securing said pump to said container, said piston extending through said piston aperture;

a dispensing tube port offset from said piston; and a collar key fitted over said cap, said collar key including:

an actuator aperture, said piston extending through said actuator aperture, a dispensing tube slot, said dispensing tube port extending through said dispensing tube slot, and a notch circumferentially offset from said dispensing tube slot, said notch being fitted over said lug of said product container such that said dispensing tube slot and said dispensing tube port must occupy a particular orientation with respect to said detent said sidewall.

* * * * *